United States Patent [19]

Marino et al.

[11] 4,433,890

[45] Feb. 28, 1984

[54] CONNECTORS FOR FLEXIBLE PRINTED CIRCUITS AND METHOD THEREFOR

[76] Inventors: Vincent E. Marino, 7 Jacqueline Ct., Port Jefferson Station, N.Y. 11776; Robert J. Nicola, 107 Atlantic Ave., West Sayville, N.Y. 11796; Karl Maier, 29 Eva La., Farmingville, N.Y. 11738; Richard W. Stockinger, 790 Sycamore Ave., Bohemia, N.Y. 11716

[21] Appl. No.: 280,941

[22] Filed: Jul. 6, 1981

[51] Int. Cl.[3] ..... H01R 4/10; H01R 43/04

[52] U.S. Cl. ..... 339/97 C; 29/866

[58] Field of Search ..... 339/97 R, 97 C, 97 P, 339/98, 99, 28, 29; 29/863, 865, 866

[56] References Cited

U.S. PATENT DOCUMENTS

| | | | |
|---|---|---|---|
| 3,752,901 | 8/1973 | Kuo | 339/95 R |
| 3,880,488 | 4/1975 | Collier et al. | 339/97 C |
| 3,997,233 | 12/1976 | Evans | 339/97 C |
| 4,037,915 | 7/1977 | Cabaud | 339/276 SF |
| 4,044,888 | 8/1977 | Schachter | 339/95 R |
| 4,263,474 | 4/1981 | Tennant | 339/97 C |

OTHER PUBLICATIONS

Ralph A. Papa; Mass Termination Technique for Flat Conductor Flat Flexible Cable and Circuitry; Oct. 1977, pp. 356–360, E. I. Dupont Nemours & Co., Inc.

*Primary Examiner*—John McQuade
*Assistant Examiner*—Paula Austin
*Attorney, Agent, or Firm*—Bauer & Amer

[57] ABSTRACT

Electrical connectors for use with relatively spaced printed circuit electrical conductors and more especially of the type contained on flexible flat conductors wherein the connectors are formed on a continuous mounting strip that retains the same in relative spaced relationship corresponding to the relative spacing of the electrical conductors such that a series of electrical connectors may be electrically engaged simultaneously in one operation with respective ones of the electrical conductors without disturbing or otherwise affecting the continuous insulating integrity between the relatively spaced electrical conductors.

10 Claims, 6 Drawing Figures

CONNECTORS FOR FLEXIBLE PRINTED CIRCUITS AND METHOD THEREFOR

The present invention relates to electrical connectors and more particularly for connection with flexible printed circuits to form flexible electrical jumpers and to a method of making the same.

Flexible printed circuits, also referred to as "flexible flat conductors", are conventionally flat sheet-like members formed on a continuous ribbon-like sheet of a nonconductive dielectric or insulating material as Mylar. Flexible copper electrical circuit strips are printed flat on the flat insulator in continuous elongated narrow lengths of approximately 0.060 inches in width. The printed conductive strips are usually retained in parallel spaced relation of approximately 0.100 inches by alternately spacing insulators formed of the Mylar material which covers the printed conductors and completes an encompassing insulating coating, all of which is substantially flat and flexible.

The aforedescribed flexible printed circuits are cut to desired lengths from the continuous sheet so as to enable their use for the completion of an electrical circuit between two or more electrically operated structures. To do this, it is necessary to provide an electrical connector that is capable of being securely engaged in electrical circuit engagement with the elongated printed circuit electrical conductor strips such that the electrical connector itself may be readily joined with and make a complete electrical circuit with the electrically operated structures.

In use it is important that damage to the insulation spacing the printed electrical conductors be avoided to prevent electrical shorting between adjacent conductors. At present, there are no known electrical connectors that may be used with such aforedescribed flexible printed circuits without disturbing the unitary continuous integrity or without perforating or interfering with the dielectric insulators alternately spaced between the printed electrical conductors.

U.S. Pat. Nos. 3,713,072 and 3,715,457 each teach electrical connectors that disturb the spacing insulators between the printed conductors, as by perforating to complete the connection with their respective or selected printed conductors. Disturbance of the insulator between adjacent printed circuit conductors presents a potential for electrical shorting across the adjacent conductors. In U.S. Pat. Nos. 3,138,658, 3,247,316, 3,253,247, 3,541,226 and 3,752,901 the connectors there disclosed are used with conductor foils that lack spacing insulation and, therefore, do not concern themselves with the problem of the present invention.

The present invention, recognizing the limitations of the prior art, teaches an electrical connector that is capable of being manufactured in a continuous strip similar to that disclosed in U.S. Pat. Nos. 3,993,383 and 4,044,888, but differs therefrom by enabling all of the electrical connectors relatively spaced on and along the strip to be simultaneously pressed and secured into electrical circuit engagement with respective ones of the printed electrical conductors on the flexible printed circuit without disturbing the integrity of the spacing insulators while providing the overlying alignment of each of the electrical connectors with its respective conductor.

Accordingly, an object of the present invention is to provide an electrical connector that is of a width equal to or narrower than that of the electrical conductor with which it is to make electrical circuit engagement.

Another object of the invention is to provide an electrical connector that makes electrical circuit engagement with its respective printed electrical conductor by the use of structure thereon that accurately positions the electrical conductor in the connector to enable a locking electrical circuit engagement that resists separation and relative movement therebetween to enable the combined electrical connector and flexible printed circuit to be used as a flexible jumper between structures that may even have substantial relative, albeit violent, vibrating movements.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein.

Figure 2:
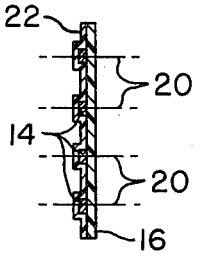
FIG. 2 is a cross-section of FIG. 1 taken along lines 2—2.
Figure 1:
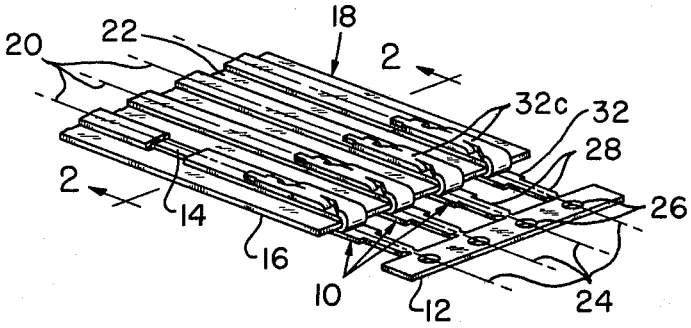
FIG. 1 is a perspective view of a strip of a plurality of electrical connectors according to the teaching of the invention each of which is engaged in electrical circuit engagement with a respective one of a printed circuit electrical conductor of a flexible flat printed circuit sheet to form a part of a flexible jumper.

Referring to FIGS. 1 and 2, there is shown a plurality of the electrical connectors each generally identified by the numeral 10 unitarily strung together on and comprising a physical part of a base strip or stringer 12. The connectors 10 in FIG. 1 are shown connected in electrical circuit engagement with a respective one of a plurality of electrical conductors 14 printed on a flexible sheet 16 that forms a flexible printed circuit or flexible flat conductor generally identified by the numeral 18.

As illustrated in FIGS. 1 and 2 for ease of explanation and understanding of the invention each of the electrical conductors 14 is generally printed along a continuous length of the flexible dielectric or nonconductive insulator base sheet 16 commonly made of Mylar. The printed conductors 14 are spaced substantially parallel to each other along centers as indicated by the lines 20 that are about 0.100 inches apart and are insulated by alternate spacing insulators in the covering 22 as can be seen more clearly in FIG. 2. The width of each printed electrical conductor 14 is in the order of 0.060 inches. Any disturbance to, as the perforation of or interference with the integrity of the alternately spacing insulation 22, narrows the already small space between the conductors 14 and thereby increase the possibility of electrical shorting across them.

In light of the foregoing, each of the electrical connectors 10 of the present invention is constructed of a width not to exceed 0.060 inches that is equal to and also preferably narrower than the width of the electrical conductors 14 with which they are intended to be clamped and locked into electrical circuit engagement. The electrical connectors 14 are formed one at a time as a unitary or monolithic extension of the base stringer strip 12. Thus, as the solid strip of ribbon-like sheet metal 12 is moved steppingly through progressive forming dies (not shown), the electrical connectors 10 are developed and formed from the ribbon-like sheet to produce the appearance of the development as shown in FIG. 3.

Figure 3:
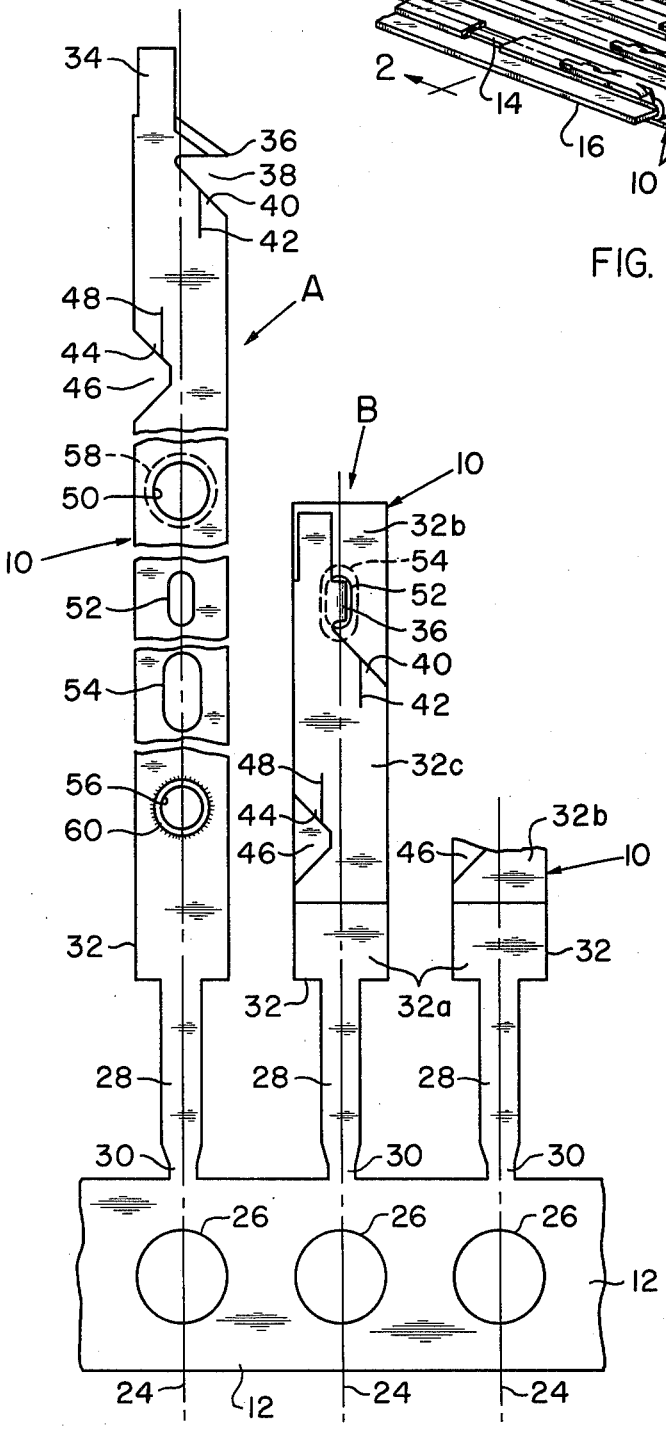
FIG. 3 is a plan view showing the development steps in the manufacture of the electrical connector.

Reference is now made to FIGS. 3, 4, 5 and 6. In the development of FIG. 3 portions of the ribbon-like sheet of an electrical conductive material is initially cut away and removed to produce the first stage, generally identified "A" (FIG. 3) in the development of the electrical connector 10. The development A includes the continuous stringer 12 of the ribbon of base metal that is continuously and unitarily formed with the development outline of a first stage A of the electrical connector 10. The stage A electrical connector 10 is initially formed flat and elongated longitudinally along a respective center line 24 that coincides with an indexing aperture or hole 26 and is unitarily joined by a narrowed extension of tab connector 28 that is tapered to a weakened area 30 at which the electrical connector 10 is subsequently intended to be severed from the strip 12.

The tab connector 28 merges with a wider electrical connector body 32 that is initially elongated in length as is illustrated in a first step A of the development of the electrical connector 10. The body 32 terminates in a narrowed tip end 34 that results from the removal of part of the body to form a sharp-sided, pointed knife-shaped electrical contact 36 that is shown to project from the side of the body at the cutaway portion 38. The knife contact 36 is of substantial length so as to enable it to subsequently pierce and pass fully through its respective electrical conductor 14 and to be bent thereafter into locking engagement with the surface of the body 32 in a manner to be described and as will be seen more clearly in FIG. 6.

Adjacent to the cutaway portion 38 is a further electrical contact in the form of a blade that functions as a lance or prong 40 that is of such length sufficient to pierce and enter into the respective electrical conductor 14 without passing fully therethrough as will be described. The prong 40 is readily formed by the sloping wall of the cutaway 38 and a slit 42 that extends inward of the body 32 from the sloping wall of the cutaway 38. In addition to performing the function of a further electrical contact the blade prong 40 also serves as a positioning means to retain its electrical connector 10 in longitudinal alignment with its respective printed circuit electrical conductor 14 with which it makes electrical circuit engagement as will become clear.

Although in practice one electrical contact lance or prong 40 as described is sufficient to resist relative displacement or movement between the connector 10 and its respective printed electrical conductor 14, additional such contact and positioning means may be provided. For example, additional electrical contact and positioning means may be provided at 44 whereat there is a sloped wall cutaway 46 from which a prong forming slit 48 is made. Each of the electrical contacts 36, 40 and 44 are adapted to be bent into lancing position out of the plane of the body 32 in a later progressive step as will become clear.

Located along the length of the body 32 are a plurality of openings 50, 52, 54 and 56 each spaced from the other along the length of the body 32. The opening 50 is shown of circular shape and has a flared perimetral surface 58 on one side of the body 32. The opening 52 may be of any desired shape as may be the larger oval opening 54. The opening 56 is formed by striking upward the wall 60 of the opening from the underside of the body 32 so that the upstanding wall conforms to the size and shape of the hole 50 and assumes the function of a rivet that is subsequently adapted to be engaged with the flared surface 58 thereof.

During a following progressive forming step the outlined development of the electrical connector 10 of stage A is transformed to the three layered or surfaced structure as shown in plan view at the development step "B" of FIG. 3. The constructural features of the step B development are more clearkly seen in the side view of FIG. 4. In the development step B which may be the result of one or more intermediate progressive steps, the body 32 is bent and folded upon itself so as to retain its monolithic and unitary continuity. Thus, the body 32 is transformed from its elongation as shown at step A to its overlying layers of the development step B wherein it has the base outer surface 32*a*, a second or middle surface 32*b* and another top outer surface 32*c*.

The body 32 is so folded that the smaller oval opening 52 is centered in alignment with the larger oval opening 54. In like manner the opening 50 is aligned with the upstanding rivet wall 60 in such manner that the wall is then peened radially and rivetted outward to mechanically engage the flared opening 50 so as to secure the surfaces 32*a* and *b* together from separation during normal use. For all intents and purposes the surfaces 32*a* and *b* are mechanically rivetted together to prevent their relative separation. When formed into the final development stage B the outer top surface 32*c* is bent upward at a receiving angle so as to be spaced from and upward relative to the middle surface 32*b* as is more clearly shown in FIG. 4.

Figure 4:
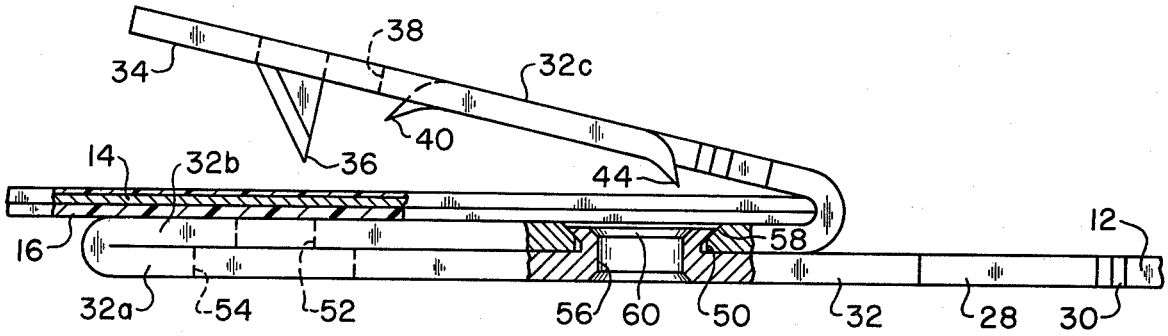
FIG. 4 is an enlarged side view of the electrical connector in its initial step of assembly with its respective printed circuit electrical conductor with a portion thereof broken away.

At the same time the knife contact 36 is bent downward for alignment with the already aligned receiving openings 52 and 54 to enable the same to pass and extend therethrough in a later step. Although the openings 52 and 54 could have another shape, their oval configuration adds strength to the surrounding walls while being sufficiently elongated to receive the elongated shape of the sharp-sided knife contact 36 therethrough. In the event one or more of the blades or lancing prongs 40 and 44 are provided, they too will be bent downward out of the plane of the body 32 to project in the direction of the middle surface 32*b* and to protrude partially into the angular space between the surfaces 32*b* and *c* as is seen in FIG. 4.

Because the base strip 12 is formed in a continuous length with the electrical connectors 10 regularly spaced parallel to each other along 0.100 inch centers 24 that coincide with the centers 20 of the electrical conductors 14 and positioning indexing holes 26, it is possible to separate selected lengths of the strip 12 and its joined connectors 10 equal in number to the electrical conductors 14 of the flexible printed circuit 18. As shown in FIG. 1, a length of four electrical connectors 10 are provided for electrical circuit engagement with the four conductors 14 of the flexible printed circuit 18. If the printed circuit 18 had conductors more or less than the four shown, then the number of connectors 10 on the strip 12 would be equal thereto.

When it is desired to assemble the joined connectors 10 as a whole, or as a unit, simultaneously with their respective conductors 14, the leading edge of the flexible printed circuit 18 is inserted into all of the angular spaces of all of the connectors 10 at one time until the same abuts and fits into engagement with the inner bend of the fold between the outer surface 32*c* and inner surface 32*b*. Respective ones of the conductors 14 and connectors 10 are aligned lengthwise with each other during such positioning. When once so aligned, all that is necessary thereafter is to close the angular space between the surfaces 32*b* and 32*c*. Since each of the connectors 10 are fixedly joined together at the stringer 12 and each of the conductors 14 are fixed in spaced relation on the sheet 16, it is now a relatively simple procedure to close the space between the two surfaces 32*b* and 32*c* by pressing them toward each other.

The closing of the space may be performed in a simple pressing step by a press (not shown) in which a sufficient closing force is applied to the outer surface 32*c* while the inner surface 32*b* and the flexible printed circuit 18 are held stationary. Inasmuch as the sharp-sided knife contact 16 and the blade prongs 40 and 44 are already in their downward directed positions as shown in FIG. 4 before the angular space is pressed closed, their pointed ends will press into the respective conductor 14 during the closing operation.

Figure 5:
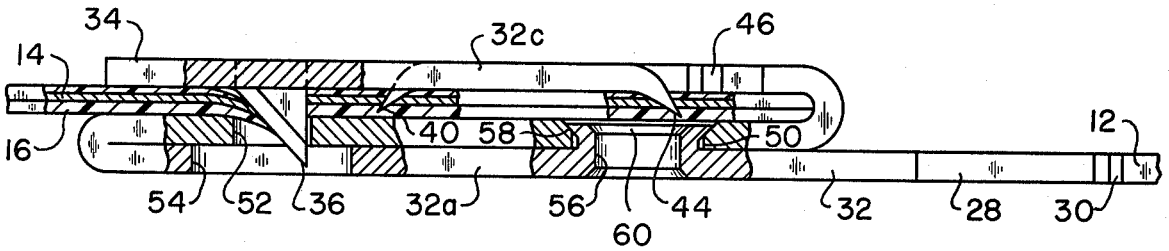
FIG. 5 is a view similar to FIG. 4 with additional portions broken away and showing an intermediate step of assembly.
Figure 6:
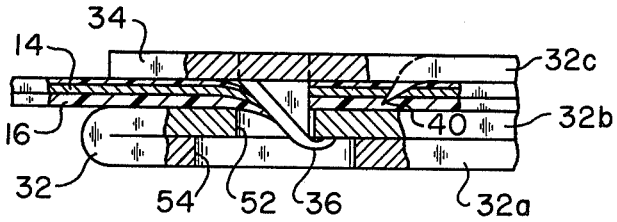
FIG. 6 is a view of a limited portion of FIG. 5 with a portion thereof broken away to show the completed steps of assembly.

The knife contact 36, being longer, sharply sided and pointed will pierce and move easily fully through the conductor 14 to penetrate and extend therebeyond as is seen in FIG. 5. This effects a positive electrical circuit engagement between the connector 10 and its respective conductor 14. The prongs 40 and 44, being of substantially shorter length, merely pass through the insulating covering 22 of the flexible printed circuit 18 and then penetrate into their respective conductor 14 to make electrical circuit contact and engagement therewith without passing or projecting therethrough as is seen in FIGS. 5 and 6.

When the knife blade contact 36 extends beyond the conductor 14 and its sheet 16, its projecting portion is then received within the elongated aligned oval openings 52 and 54. At that time it is merely necessary to cause the projecting end of the blade 36 to lock against the underside of the middle surface 32*b* so as to aid, in combination with the rivet 60, to clamp and lock all three surfaces 32*a, b* and *c* of the body 32 together against separation. This may be accomplished in the same press that was employed to simultaneously clamp closed all of the connectors 10 on the strip 12 with their respective conductors 14.

In practice, it has been found that to do this easily and effectively, and also to form a lock between the blade 36 and the middle surface 32*b*, the extending end of the blade 36 is deformed and bent back against the underside of the surface 32*b* within the enclosing defines of the larger opening 54. Because it is contained within the defines of the larger opening 54, no part or portion of the now deformed locking blade contact 36 projects beyond the surfaces of the connector 10 as is seen in FIG. 6.

Thus, the knife blade contact 36 becomes a locking element that, in addition to completing an electrical circuit between the respective conductor 14 and its connector 10, retains the whole structure of conductor 14, connector 10 and its surfaces 32 assembled and clamped together as a unit by reason of the cooperation of the rivet 60. The electrical circuit made by the knife contact 36 is further assured and enhanced by the electrical circuit engaging prongs 40 and 44. The prongs 40 and 44, however, perform the additional function of locating and positively retaining its connector 10 in lengthwise alignment with its respective conductor 14 so as to assure that relative movement therebetween is effectively resisted and prevented.

It has been found that the lock and mechanical clamp effected by the knife contact 36 resist high shock and vibration forces that are applied to the flexible jumpers 18 constructed with the present connectors 10 and that tend normally to separate the connectors from the flexible printed circuit. When one or more of the lancing prongs 40 and/or 44 are added, the joint made between the connector 10 and its conductor 14 resists even greater separation forces and relative movement therebetween.

When all of the connectors 10 are electrically engaged with their respective conductors 14, the common strip or stringer 12 is removed. This is performed in a single severing step in the same manner as all of the connectors 10 were closed and electrically connected with their respective conductors 14. That is to say, it is done in a single operation wherein the weakened or narrowed portion 30 of the tab extension 28 is severed from the stringer or strip 12. The tab 28 that remains as an extension of its connector 10 provides the means by which an electrical circuit may be completed between the respective conductor 14 and any other electrical circuit that is not shown in the present disclosure since the same forms no part of the present invention.

From what has been described, it should be clear that a full set of connectors 10 may be applied to an end of the flexible printed circuit to be joined electrically with respective conductors 14 thereof in a single operation that obviates the prior art expensive practice of applying one such connector at a time to its respective conductor. When the connectors 10 are applied to conductors 14 at both ends of the flexible printed circuit 18, a flexible jumper is provided to complete an electrical circuit across and to relatively spaced electrical structures at the tab extensions 28.

Because the connectors 10 are of a width equal to or narrower than the conductors 14 with which they are engaged as heretofore described, no part of the connectors 10 extends beyond the width of their respective conductors 14. Moreover, the connector 10 leaves the alternative spacing insulation between the conductors 14 undisturbed, including the perforation, thereby obviating any interference with or damage to the monolithic integrity of the insulators between the electrical conductors 14 that might otherwise result in shorting therebetween.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the invention, therefore, to be limited only as indicated by the scope of the claims appended hereto.

What is claimed is:

1. In an electrical connector, a one-piece continuous body bent lengthwise upon itself to form three overlying electrically connected surfaces at least two of which have a space therebetween to receive an elongated electrical conductor therein and between said two surfaces and the third of which has fastener means inseparably connecting the same in overlying relation to one of said two surfaces, knife-shaped piercing means having a lengthwise dimension greater than its widthwise dimension on and extending lengthwise in the direction of one of said two surfaces for piercing through the electrical conductor in the direction of the elongation thereof to leave the width thereof substanially undisturbed to make positive electrical connection therewith and bendable into locking cooperation with another of said two surfaces to retain said two surfaces secured together in positive electrical contact with the electric conductor engaged therebetween when the space between said two surfaces is closed, and tab means on said third surface to enable the completion of an electrical circuit with the electrical conductor through said body.

2. In an electrical connector as in claim 1, further electrical contact means on one of said surfaces spaced lengthwise from and laterally to one side of said knife-shaped piercing means and penetrating into the electrical conductor to make further positive electrical contact therewith and to anchor said electrical connector to said electrical conductor to resist relative lateral movement therebetween.

3. In an electrical connector as in claim 1, said fastener means being on said third and middle surfaces separate from said piercing means to secure the same together mechanically from normal relative separation and said middle surface is one of said two surfaces.

4. In an electrical connector as in claim 3, said body being unitary and said one surface having said knife-shaped piercing means and the middle surface of said body having means cooperating with said piercing means to secure together said one surface and the middle surface.

5. An electrical connector for use with a flexible printed circuit having a plurality of elongated printed electrical conductors relatively and alternately spaced by insulators therebetween comprising:

an elongated strip having a plurality of electrical connectors integral therewith and extending therefrom and relatively spaced therealong with said electrical connectors being equal in number and equal in spacing to the relative spacing of the elongated electrical conductors of the flexible printed circuit for electrical connection with a respective one thereof, each said electrical connector having an elongated unitary body bent upon itself to form a plurality of at least three overlying aligned surfaces at least two of which include outer and middle surfaces that have a space therebetween to receive a respective electrical conductor therein so that all the relatively spaced elongated electrical conductors of the flexible printed circuit are received at the same time in the space of their respective electrical connector, knife-shaped piercing means being elongated in length and narrow in width and positioned on each of said electrical connectors for knife-like piercing movement through its respective electrical conductor in the direction of the elongation thereof to leave the width of the electrical conductor substantially undisturbed while making positive electrical engagement therewith and without disturbing the alternately spaced insulation of its respective electrical conductor when said spaces of each of said electrical connectors are simultaneously closed over and into electrical engagement with their respective electrical conductors, said knife-shaped piercing means being bendable and means cooperating with the bent knife-shaped piercing means to lock the same in said positive electrical engagement and across said two surfaces, separate fastening means on the third of said surfaces and the middle of said surfaces normally connecting the same from separation.

6. An electrical connector as in claim 5, electrical contact means on one of said two surfaces spaced laterally from said knife piercing means and facing in the direction of said space and making electrical contact with the respective electrical conductor to provide at least a second electrical contact between said electrical connector and its respective electrical conductor and to resist lateral relative movement therebetween.

7. The method of making a flexible electrical jumper which includes a flexible conductor having a plurality of elongated electrical conductors alternately spaced thereon by insulators and a plurality of electrical connectors each electrically connected with a respective one of the electrical conductors, wherein each of the electrical connectors is of a width not greater than that of their respective electrical conductor and each is relatively spaced from the other equal to that of the relative spacing of their respective electrical conductors, the steps comprising:

positioning the flexible conductor such that each electrical conductor thereon is in a space between two surfaces of the respective electrical connector, closing the space between the two surfaces of all of the electrical connectors substantially simultaneously while completely piercing a linearly extending electrical contact through and substantially centrally along the length of the respective electrical conductor of the electrical connector without disturbing the spacing insulation of the pierced flexible conductor thereby leaving the widthwise integrity of the same unbroken, and bending the electrical contact to secure the two surfaces together with the electrical conductor therebetween and in positive electrical circuit contact therewith, and separating a third surface of each electrical connector from its held spaced relationship with each of the next adjacent spaced electrical connectors to enable the third surface of each such electrical connector to be connected with an electrical circuit, securing the third surface together with at least one of the other two surfaces against normal separation and in overlying alignment with the other two surfaces by a separate securement each that all three surfaces lie in the same line with their respective electrical conductor and are out of overlying relation with the spacing insulators of their respective electrical conductor.

8. An electrical connector comprising an elongated continuous body folded upon itself to form at least three surfaces each overlying the other with an initial space formed between one of the outer surfaces and the middle surface for the receipt of an elongated electrical connector therebetween to be connected in electrical circuit engagement with said connector and the middle surface and another outer surface having securing means engaged together normally to secure said middle and other outer surfaces against separation, knife-shaped contact means extending lengthwise on one of said space forming surfaces for penetration in the direction of the length of and fully through the electrical conductor that is in the space when the space is closed and bendable for locking connection with at least another of said surfaces so as to retain the space closed and said contact means in electrical circuit engagement with the electrical conductor in said space, and tab means on one of said surfaces for completion of an electrical circuit with said electrical conductor through said body.

9. An electrical connector as in claim 8, a continuous strip, and wherein there is a plurality of said electrical connectors formed unitary with said strip each at their respective tab means such that each of said electrical connectors is retained by said strip in fixed spacing therealong.

10. An electrical connector as in claim 9, said electrical connectors each being of a width of 0.060 inches and narrower and being spaced 0.100 inches from each other along said strip.

* * * * *

UNITED STATES PATENT AND TRADEMARK OFFICE

CERTIFICATE OF CORRECTION

PATENT NO. : 4,433,890

DATED : February 28, 1984

INVENTOR(S) : Vincent E. Marino, et al

It is certified that error appears in the above-identified patent and that said Letters Patent are hereby corrected as shown below:

IN THE CLAIMS:

Claim 7, line 37, change "each" to --such--

Signed and Sealed this

*Nineteenth* Day of *June 1984*

[SEAL]

*Attest:*

GERALD J. MOSSINGHOFF

*Attesting Officer*

*Commissioner of Patents and Trademarks*